US009155438B2

(12) United States Patent
Park

(10) Patent No.: US 9,155,438 B2
(45) Date of Patent: Oct. 13, 2015

(54) EXTENSION PIPE ASSEMBLY FOR A VACUUM CLEANER

(75) Inventor: Seon Bin Park, Buk-gu Gwangju (KR)

(73) Assignee: KWANG DONG & HITECH CO., LTD., Gwang-ju (KR)

( * ) Notice: Subject to any disclaimer, the term of this patent is extended or adjusted under 35 U.S.C. 154(b) by 499 days.

(21) Appl. No.: 13/498,183

(22) PCT Filed: Aug. 3, 2010

(86) PCT No.: PCT/KR2010/005082

§ 371 (c)(1),
(2), (4) Date: Mar. 26, 2012

(87) PCT Pub. No.: WO2011/040699

PCT Pub. Date: Apr. 7, 2011

(65) Prior Publication Data

US 2012/0180242 A1 Jul. 19, 2012

(30) Foreign Application Priority Data

Sep. 29, 2009 (KR) ..... 10-2009-0092176

(51) Int. Cl.
*A47L 9/24* (2006.01)

(52) U.S. Cl.
CPC ..... *A47L 9/244* (2013.01); *A47L 9/246* (2013.01)

(58) Field of Classification Search
CPC ..... A47L 9/02; A47L 9/244; A47L 9/04; A47L 9/0411; A47L 9/325; A47L 9/327; A47L 5/30; A47L 5/28
USPC ..... 15/414, 377, 410, 145.1, 145.3, 145.4; 285/7, 145.1, 145.4
See application file for complete search history.

(56) References Cited

U.S. PATENT DOCUMENTS 3,244,437 A * 4/1966 Belicka et al. ..... 285/7
3,614,705 A * 10/1971 Descarries et al. ..... 439/23

(Continued)

FOREIGN PATENT DOCUMENTS

JP 08-322722 A 12/1996
JP 2019990010000 U 3/1999

(Continued)

OTHER PUBLICATIONS

International Search Report: mailed Apr. 28, 2011; PCT/KR2019/005082.

*Primary Examiner* — Dung Van Nguyen
(74) *Attorney, Agent, or Firm* — Ladas & Parry LLP

(57) ABSTRACT

The present invention relates to an extension pipe assembly for a vacuum cleaner. The disclosed extension pipe assembly comprises: a suction pipe including an external pipe and an external power supply pipe which is coupled to the bottom surface of the external pipe, and to the interior of which a movable member is coupled; a flexible pipe including an internal pipe and a power supply pipe attached to the bottom surface of the internal pipe, wherein the flexible pipe is coupled to the suction pipe such that the length of the flexible pipe is adjustable; and length adjustment means joined to the coupling portion between the suction pipe and the flexible pipe so as to lock or unlock the length adjustment function of the flexible pipe and of the suction pipe. The power supply pipe is formed into a single pipe, on both internal walls of which respective conductor plates are formed to as to contact the movable member. When the power supply pipe is inserted into the external power supply pipe, the movable member is inserted into the power supply pipe such that the movable member is movable and contacts the conductor plates to maintain a power supply state.

4 Claims, 6 Drawing Sheets

(56) References Cited

U.S. PATENT DOCUMENTS

| | | | | |
|---|---|---|---|---|
| 5,740,583 | A * | 4/1998 | Shimada et al. | 15/377 |
| 6,148,474 | A * | 11/2000 | Ohara et al. | 15/377 |
| 6,513,191 | B1 * | 2/2003 | Kim | 15/414 |
| 7,883,116 | B2 * | 2/2011 | Canale | 285/7 |
| 8,038,173 | B2 * | 10/2011 | Canale | 285/7 |
| 2002/0020541 | A1 * | 2/2002 | Stein | 174/47 |
| 2007/0157425 | A1 * | 7/2007 | Battle | 15/414 |

FOREIGN PATENT DOCUMENTS

| | | | |
|---|---|---|---|
| KR | 1019970014681 | A | 4/1997 |
| KR | 1019990047878 | A | 7/1999 |

* cited by examiner

EXTENSION PIPE ASSEMBLY FOR A VACUUM CLEANER

TECHNICAL FIELD

The invention relates to a pipe structure of a vacuum cleaner, and more particularly, to an extension pipe assembly for a vacuum cleaner which has a power supply unit to supply power to a brush assembly of the vacuum cleaner.

BACKGROUND ART

Generally, vacuum cleaner draws in dust or foreign matters on a floor through a brush assembly using a suction force which is generated when a fan motor, mounted inside the cleaner body, is driven.

Vacuum cleaners with improved cleaning efficiency have been provided, in which brushes mounted inside the brush assemblies are rotated by the motors to efficiently draw in dust or foreign matters.

Further, some vacuum cleaners have the brush assemblies equipped with steam generating devices for the purpose of steam cleaning.

In the above-mentioned vacuum cleaners, it is necessary that the power is supplied to the brush assembly to rotate the brush and drive the steam generating device. Accordingly, the vacuum cleaner additionally includes a power supply pipe in which a power line is provided to supply power to the brush assembly.

An example of a conventional pipe structure can be referred to the Korean Utility Model Registration No. 0270655 which discloses a pipe of a vacuum cleaner.

Referring to the Korean Utility Model Registration No. 0270655, a conventional pipe of a vacuum cleaner includes an internal suction pipe which draws in dusts or the like, an internal power supply pipe which includes a power supply means arranged near to a lower portion of the internal suction pipe to supply power to the brush assembly, and an external pipe having respective receiving portions integrally formed therein to receive therein the internal suction pipe and the internal power supply pipe, respectively.

Further, a separate power supply means is provided inside the internal power supply pipe, in which the power supply means includes a fixing member, a movable member and a cover. The fixing member includes hooks formed on both side portions to be inserted into the fixing holes of the cover and to thus form integrated power supply means. The power supply means formed as explained above is then insertedly assembled into the internal power supply pipe.

Further, in the conventional examples, the internal suction pipe and the power supply pipe and the external pipe are made from a metal material.

Accordingly, since a conventional pipe for a vacuum cleaner is relatively heavy, a user has inconvenience when using the vacuum cleaner.

Further, since the conventional pipes are made from metal material and the external pipe has respective receiving portions formed integrally, fabrication is relatively complicated and requires relatively high manufacture cost.

Further, since the pipe of the vacuum cleaner requires a separate power supply means independently from the internal power supply pipe, the configuration becomes complex, and fabrication and assembling become complicated due to use of many unnecessary parts.

Further, since the movable member has a power line fixing groove receiving therein the power line, and a plurality of stamping protrusions with triangular perpendicular cross sections provided to prevent separation of the power line from the power line fixing groove, fabrication is complicated, and supporting force may deteriorate when the movable member is slidably moved inside the power supply means. Further, the cutting edge may cut the power line when placed under pressure.

DISCLOSURE

Technical Problem

Accordingly, the present invention has been made to overcome the problems of the prior arts explained above, and an object of the present invention is to provide an extension pipe assembly of a vacuum cleaner, which is light-weighted and has a power supply portion to provide power to a brush assembly of the vacuum cleaner.

Furthermore, another object of the present invention is to provide an extension pipe assembly of a vacuum cleaner, which is easy to fabricate and assemble.

Technical Solution

In order to achieve the object of the invention, an extension pipe assembly for a vacuum cleaner in one embodiment may include a suction pipe including an external pipe and an external power supply pipe which is coupled to the bottom surface of the external pipe, and to the interior of which a movable member is coupled, a flexible pipe including an internal pipe and a power supply pipe attached to the bottom surface of the internal pipe, wherein the flexible pipe is coupled to the suction pipe such that the length of the flexible pipe is adjustable, and length adjustment means joined to the coupling portion between the suction pipe and the flexible pipe so as to lock or unlock the length adjustment function of the flexible pipe and of the suction pipe, wherein the power supply pipe is formed into a single pipe, on both internal walls of which respective conductor plates are formed to as to contact the movable member so that when the power supply pipe is inserted into the external power supply pipe, the movable member is inserted into the power supply pipe such that the movable member is movable and contacts the conductor plates to maintain a power supply state.

The movable member may include a recess hole comprising, on at least one of upper and lower surfaces, a plurality of stamping protrusions to fix a power line with an end facing a middle portion being formed in a planar shape, the power line firmly seated in the recess hole, and a conductive movable piece having a surface of a middle portion protruded to outside and coupled to an end of the power line.

The power supply pipe may include a tubular casing having an upper open portion, conductive pipes fixedly attached and extended along an entirety of a length direction of the casing on both inner walls of the casing, and a cover which sealingly closes an upper portion of the casing.

The casing and the cover may be formed from a material that can be processed by ultrasonic welding so as to be ultrasonic welded to each other.

The external power supply pipe may be made from a material that can be processed by ultrasonic welding, and integrally and fixedly coupled to a bottom surface of the external pipe by ultrasonic welding.

Advantageous Effects

Since the power supply pipe and the external power supply pipe are made from plastic material, the vacuum cleaner is light-weighted, so that cleaning and carrying around of the vacuum cleaner can be performed with less force.

Further, since the external pipe does not have a power supply pipe therein, number of parts decreases, fabrication becomes easier, and assembly becomes simpler.

Further, regarding the stamping protrusions formed on a groove of the movable member receiving therein a power line, since a plurality of stamping protrusions, each having an end facing a middle portion in planar shape, are formed on either upper or lower surface to reinforce force to support the power line, accommodating the power line becomes easier and cutting of power line can be prevented.

Further, since the external casing and external cover of the external power supply pipe, external pipe and external power supply pipe, internal pipe and power supply pipe and casing and cover of the power supply pipe are coupled to each other by ultrasonic welding, fabrication is easy, and contacting surfaces are coupled to each other so firmly that no deformation or degradation is generated.

BEST MODE

[Mode for Invention]

The embodiments of the invention will be explained in greater detail below with reference to the accompanying drawings of a pipe structure of a vacuum cleaner.

Figure 1:
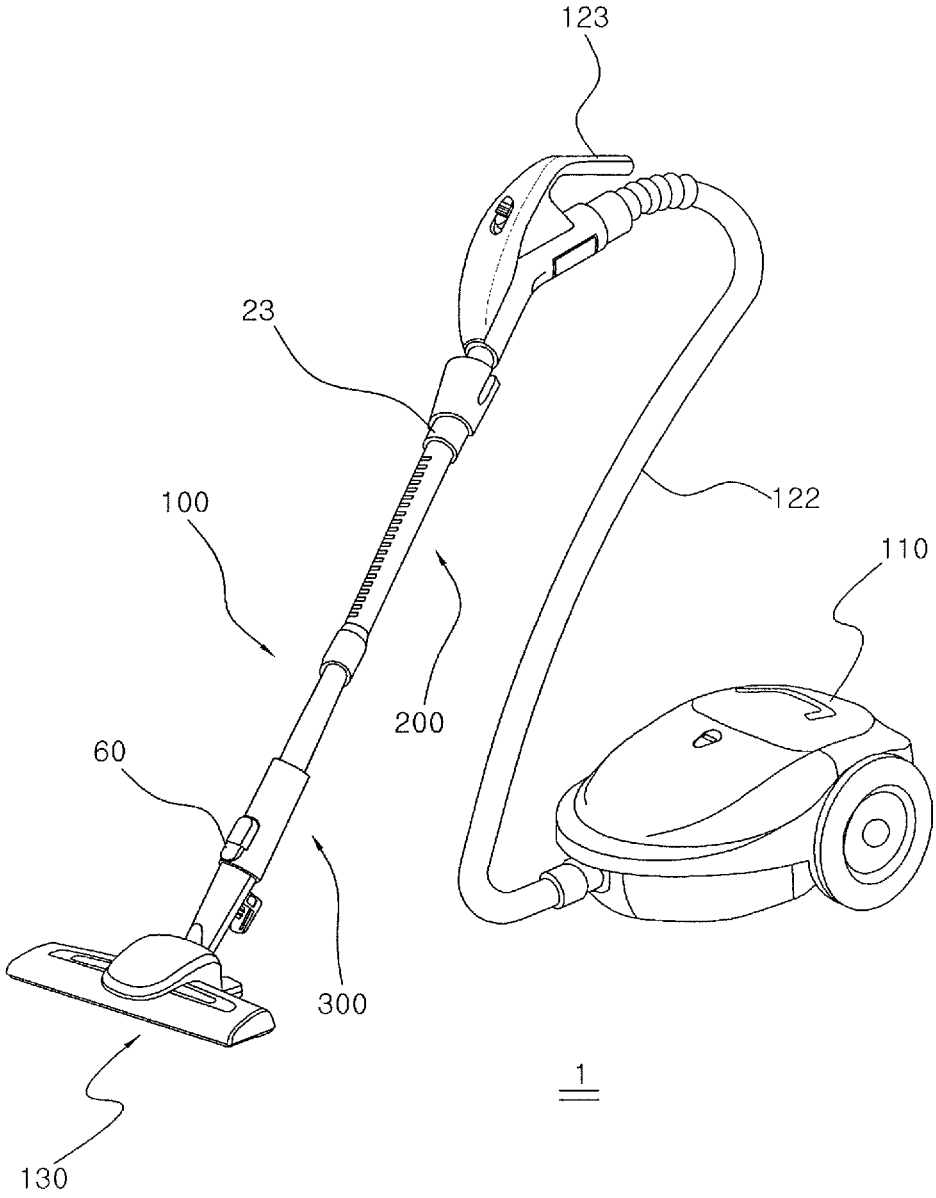
FIG. 1 is a perspective view of a vacuum cleaner 1 having an extension pipe assembly 100 according to an embodiment of the invention.

FIG. 1 is a perspective view of a vacuum cleaner 1 having an extension pipe assembly 100 according to an embodiment of the invention.

Referring to FIG. 1, the vacuum cleaner 1 may include a main body 110 which separates and collects foreign matters from sucked air, a brush assembly 130 which draws in foreign matters on a cleaning surface along with external air with the suction force generated in the main body 110, an extension pipe assembly 100 which introduces the air entraining the foreign matters drawn in by the brush assembly 130 into the main body 110, a handle 123 attached to an upper end of the extension pipe assembly 100 and a hose 122 which connects the handle 123 and the main body 110.

For convenience of cleaning, the extension pipe assembly 100 may include a flexible pipe 200 (FIG. 2) and a suction pipe 300 (FIG. 2) which are flexibly connected to each other by a length adjusting means 40.

The brush assembly 130 may include a brush (not illustrated) rotated by a brush motor (not illustrated) formed therein to provide higher efficiency of cleaning.

Accordingly, a power line to supply power of the main body 110 to the brush assembly 130 may be accommodated in the hose 122, the handle 123 and the extension pipe assembly 100.

Further, the extension pipe assembly 100 may be configured to be flexible and also to ensure that the power of the main body 110 is supplied to the brush assembly 130 without being obstructed.

The embodiments of the extension pipe assembly 100 will be explained below with reference to FIGS. 2 to 6 which illustrate the constitution of the extension pipe assembly 100.

Figure 2:
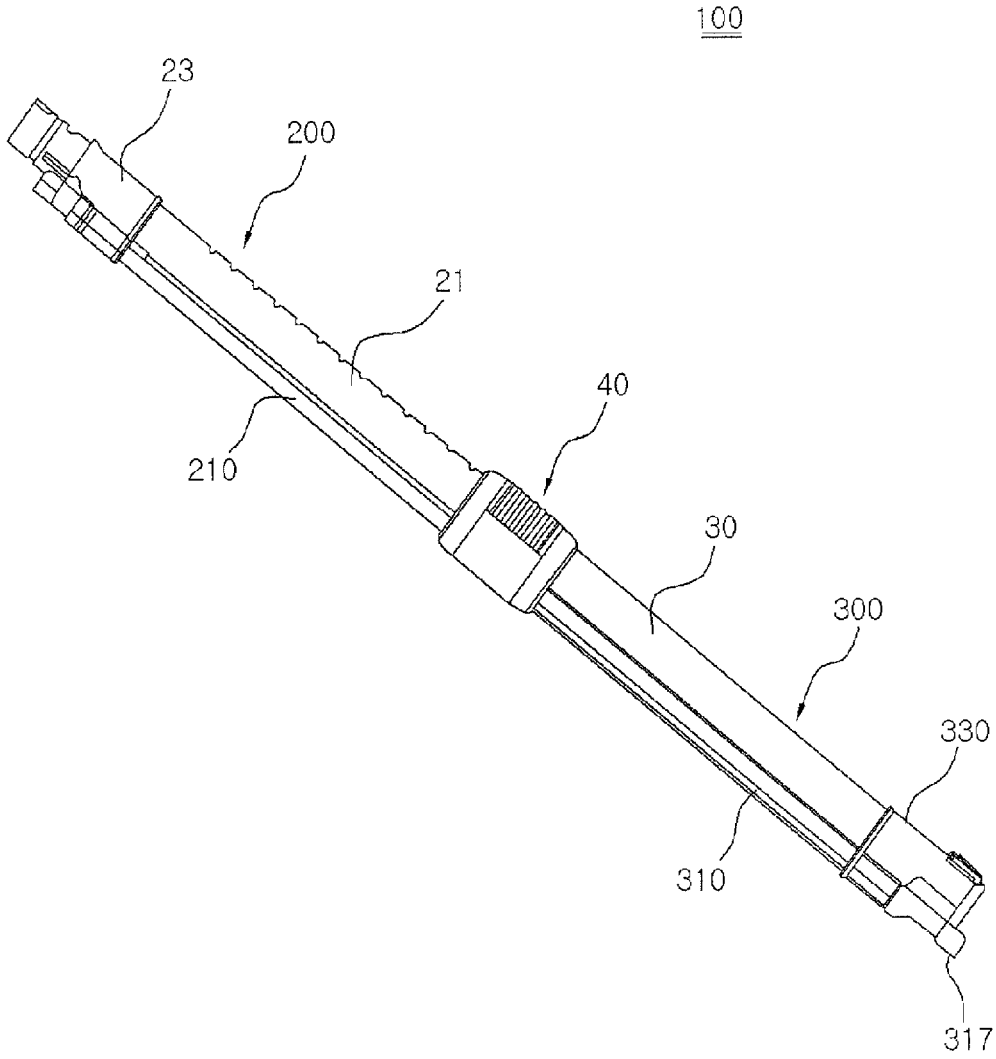
FIG. 2 is a perspective view of the extension pipe assembly 100.
Figure 3:
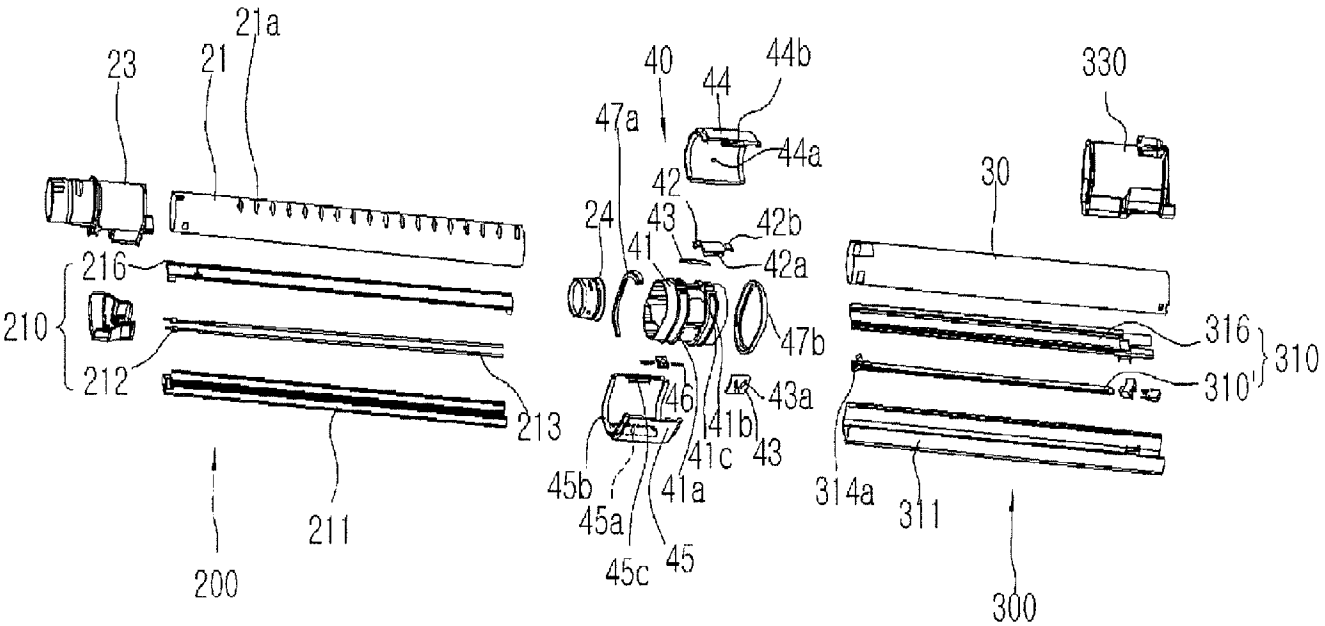
FIG. 3 is an exploded perspective view of the extension pipe assembly 100 of FIG. 2.
Figure 4:
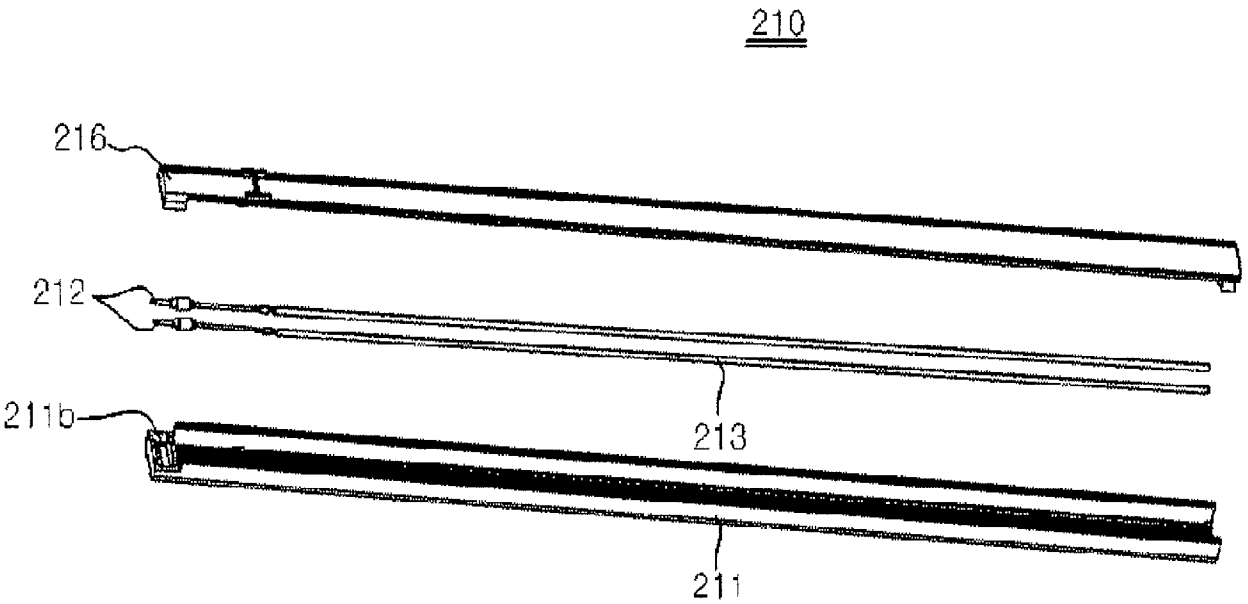
FIG. 4 is an exploded perspective view of the power supply pipe 210 of FIG. 3.
Figure 5:
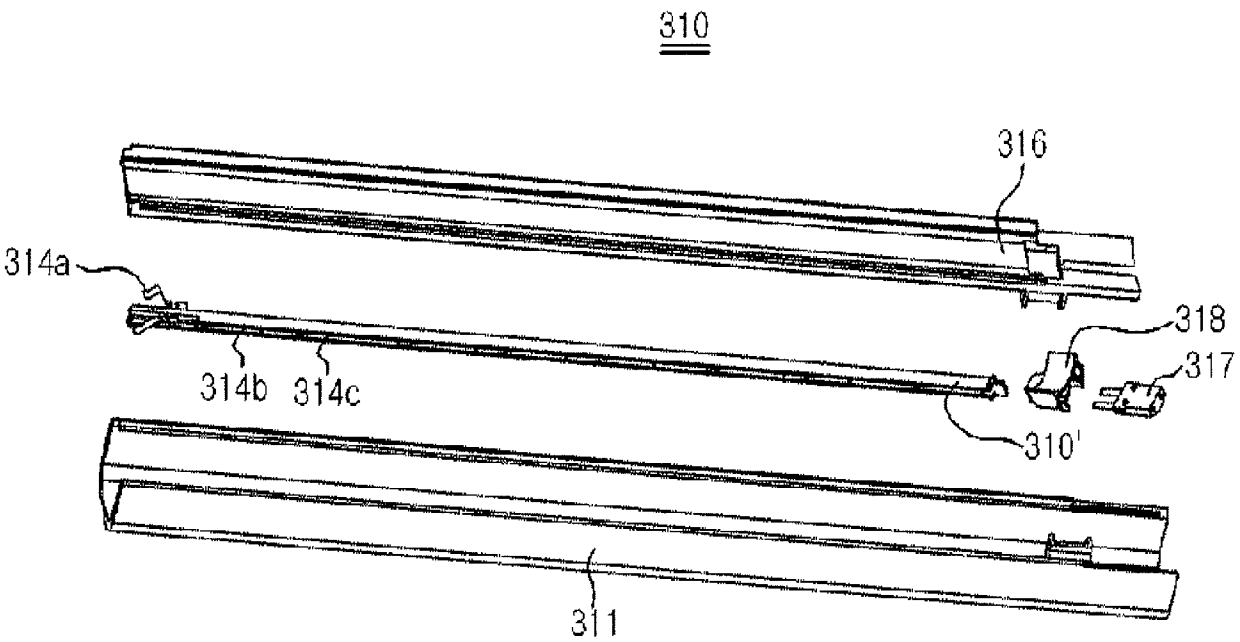
FIG. 5 is an exploded perspective view of the external power supply pipe 310 of FIG. 2.

FIG. 2 is a perspective view of the extension pipe assembly 100, FIG. 3 is an exploded perspective view of the extension pipe assembly 100 of FIG. 2, FIG. 4 is an exploded perspective view of the power supply pipe 210 of FIG. 3, and FIG. 5 is an exploded perspective view of the external power supply pipe 310 of FIG. 2.

Referring to FIG. 2, the extension pipe assembly 100 may include a flexible pipe 200, a suction pipe 300 coupled to an outer circumference of the flexible pipe 200 to be able to adjust length thereof, and a length adjusting means 40 firmly coupled to an end of the suction pipe 300 on a portion where the suction pipe 300 and the flexible pipe 200 are coupled to each other, to lock or unlock relative movement of the flexible pipe 200 and the suction pipe 300 to each other.

The flexible pipe 200 may include an internal pipe 21, a power supply pipe 210, and an end cover 23 which fixes the internal pipe 21 and an end of the power supply pipe 210 closer to the handle 123, and a separation preventive cover 24 coupled to an end of the internal pipe 21 to prevent separation when the internal pipe 21 is inserted in the external pipe 30 (FIG. 3).

The internal pipe 21 may be provided as a circular pipe having a plurality of locking holes 21*a* formed at predetermined intervals on an upper surface so that the internal pipe 21 is locked with the length adjusting means 40 in a state of being inserted into the suction pipe 300 thereby blocking further movement thereof, or unlocked and allowed to move again.

Referring to FIGS. 3 and 4, the power supply pipe 210 may include a casing 211 in the form of a tube with square cross section with upper open portion, and having a cross section area for insertion inside the external power supply pipe 310, a cover 216 tightly attached to the upper open portion of the casing 211, and conductor plates 213 each having a plug 212 formed on one end and attached lengthwise along both internal sidewalls.

The casing 211 and the cover 216 may be formed from plastic material which can be processed by ultrasonic welding. Accordingly, when the conductor plates 213 are attached to the internal walls, respectively, the upper cover 216 and the casing 211 are connected to cover the upper open portion, and fixed by the ultrasonic welding.

Referring to FIGS. 2 and 3, the suction pipe 300 may include an external pipe 30 into which the internal pipe 21 is movably inserted, an external power supply pipe 310 attached to a bottom surface of the external pipe 30, and a brush cover 330 coupled to the external pipe 300 and an end of the external power supply pipe 310 closer to the brush assembly 130 to be coupled to and separated from the brush assembly 130.

The external pipe 30 may be provided in the form of a tube having such a cross section area that the internal pipe 21 can be movably fit in the external pipe 30.

When the power supply pipe 210 is inserted, the external power supply pipe 310 provides electric contact with the conductive plates 213 to thereby transmit the power supplied from the flexible pipe 200 to the brush assembly 130.

Referring to FIGS. 3 and 5, the external power supply pipe 310 may include an external casing with an upper open portion, provided in the form of a tube having such a cross section area that the power supply pipe 210 is received therein, an external cover 316 to sealingly cover the upper open portion, and a movable member 310' inserted into the power supply pipe 210 to be moved inside the power supply pipe 210 in contact with the conductor plates 213 in accordance with the extension of the extension pipe assembly 100. The external casing 311 and the external cover 316 may also be made from plastic material that can be processed by ultrasonic welding so that these can be fixedly coupled by the ultrasonic welding.

The movable member 310' may be configured so that when inserted into the power supply pipe 210, the movable member 310' keeps short-circuited state and contacted to the conductor plates 213 to supply power.

To this purpose, referring to FIG. 5, the movable member 310' may include recesses 314*b* extended in lengthwise directions on both side surfaces, two electrically-connected power lines 319 inserted in the recesses 314*b*, a movable piece 314*a* formed on one end of each of the power lines 319, and a connector 317 connected to the other end of each of the power lines 319.

The movable piece 314*a* may be made from metal material and provided in U-shape, with an externally-curved portion facing an outer side of the recess 314*b*.

The recesses 314*b* may each include a plurality of stamping protrusions 314*c* in lengthwise direction on upper and lower surfaces. The stamping protrusions 314*c* may be configured so that an end facing an inside of the recess 314*b* is in plane square form, to provide easy fabrication, and easy and firm accommodation of the power lines 319 while preventing cutting of the power lines 319.

Referring to FIG. 3, the length adjusting means 40 may include a sleeve 41, a locking plate 42, a pressing plate 43 and sliding covers 44, 45.

The sleeve 41 may include two restricting protrusions 41*a*, 41*b* formed on an external circumference and at distance from each other in the direction of an axis, and a piercing slot 41*c* formed between the restricting protrusions 41*a*, 41*b* and in the direction of axis.

The locking plate 42 may include fixing protrusions 42*a* protruding from both sides of the lower surface, and elastic pieces 42*b* formed on both ends to elastically bias the locking plate 42 downward.

The pressing plate 43, which may be provided as a square arc-shaped plate, may have a V-shaped cam groove 43*a* formed therein.

The sliding cover may be provided in halves 44, 45, and may have an oval shape. One sliding cover half 44 may include a hook 44*b* formed on one side, and a movable protrusion 44*a* formed on an inner circumference, and the other sliding cover half 45 may include fixing holes 45*c* formed on both ends, and supporting protrusions 45*a* formed on internal circumference, a seating hole 45*b* halved by the supporting protrusion 45*a* and a coil spring 46 inserted in the seating hole 45*b*.

In the structure explained above, a locking plate 42 is inserted into the piercing slot 41*c* of the sleeve 41, the pressing plate 43 is inserted between the restricting protrusions 41*a*, 41*b*, the movable protrusion 44*a* of the sliding cover 44 is inserted into the cam groove 43*a* of the pressing plate 43 so that the hook 44*b* of the sliding cover 44 and the fixing hole 45*c* of the sliding cover 45 are elastically coupled to each other to surround the sleeve 41, and the sliding covers 44, 45 are fixed by the oval-shaped covers 47*a*, 47*b* to thus form the length adjusting means 40.

Figure 6:
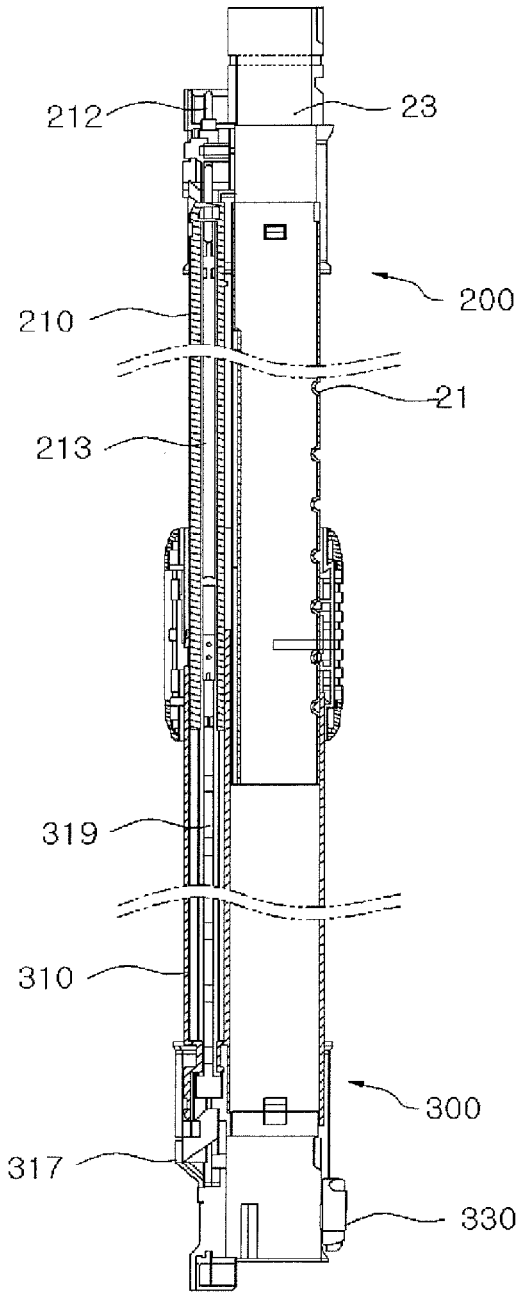
FIG. 6 is a cross-section view taken along a lengthwise direction of the extension pipe assembly 100 of FIG. 2.

FIG. 6 is a cross section view taken along a lengthwise direction of the extension pipe assembly 100 of FIG. 2.

Referring to FIGS. 2 to 6, the connecting structure and operation of the extension pipe assembly 100 will be explained.

Referring to FIGS. 2 to 4 and 6, the power supply pipe 210 may be formed by coupling the casing 211 and the cover 216 by ultrasonic welding so that the conductor plates 213 are fixed to the internal wall of the casing 211 and the plug 122 is exposed to outside.

The end cover 23 may be coupled to an end of the power supply pipe 210 on which the plug 212 is formed. The plug 212 may be exposed to the direction of the handle 123 from the lower end of the end cover 23.

An end of the internal pipe 21 may be fixedly coupled to the upper portion of the end cover 23, and as the separation preventing cover 24 is fit around the other end of the internal pipe 21, the flexible pipe 200 is assembled.

Further, after being accommodated inside the external power supply pipe 310 formed by ultrasonic welding the external casing 311 and the external cover 316, the movable member 310' may be fixed by the connector 317 to expose a terminal connected to the power lines 319 to outside.

When the movable member 310' is coupled to the external power supply pipe 310, an upper surface may be brought into close contact with the bottom surface of the external pipe 30 and fixedly coupled with the external pipe 30 by ultrasonic welding.

After that, the suction pipe 300 may be integrally assembled, as the brush cover 330 is coupled to the external pipe 30 and to an end portion of the external power supply pipe 310 in a manner in which the connector 317 is exposed to outside.

When the internal pipe 21 of the flexible pipe 200 is integrally assembled, an end to which the separation preventing cove 24 is coupled may be inserted into the external pipe 30, and the power supply pipe 210 may be inserted into the external power supply pipe 310 to be coupled to the suction pipe 300. After the movable member 310' is inserted into the external power supply pipe 310, the movable pieces 314*a* formed on both ends of one end portion of the movable member 310' may be slidably contacted to the respective conductor plates 213.

After that, the length adjusting means 40 may be assembled and coupled to an end of the suction pipe 300 closer to the flexible pipe 200 to lock insertion of the flexible pipe 200 into the suction pipe 300, or lock the extending of the flexible pipe 200 to outside, or unlock.

In the above example, the integral extension pipe assembly 100 may be formed as the length adjusting means 40 is fixed at an end of the suction pipe 300 and the fixing protrusions 42*a* of the locking plate 42 are inserted into the fixing holes 21*a* formed in upper portion of the internal pipe 21 of the flexible pipe 200.

The extension pipe assembly 100 assembled as explained above is coupled to the brush assembly 130 so that the end cover 23 is coupled to the handle 123, allowing the plug 212 formed on a lower end to be inserted into a power socket (not illustrated) formed on the handle 123, and the brush cover 330 coupled with the suction pipe 300 is connected to the connector 317 and a plug (not illustrated) formed on the brush assembly 130.

As a result, the extension pipe assembly 100 is mounted in the vacuum cleaner 1, to form a suction path and also supply power of the main body 110 to the brush assembly 130.

As explained above, in a state that the extension pipe assembly 100 is mounted in the vacuum cleaner 1, if a user moves the sliding covers 44, 45 of the length adjusting means 40 to a predetermined direction, the two pressing plates 43 are moved apart from each other by the V-shaped cam groove 43*a* to thus release the pressing of the pressing plate 43. As a result, the fixing protrusions 42*a* are separated from the fixing holes 21*a*, unlocking the flexible pipe 200 so that the flexible pipe 200 is allowed to move within the suction pipe 300.

It is possible that a user adjusts the length of the flexible pipe 200 by adequately moving the same in a state that the locking is released by the length adjusting means, and in this case, since the movable piece 314*a* slidably moves while maintaining contact with the conductor plates 213, power supply from the flexible pipe 200 to the suction pipe 300 is not blocked.

When the length of the extension pipe assembly 100 is adjusted appropriately, as the user releases the sliding covers 44, 45, the sliding covers 44, 45 are returned to the original location by the elastic force, so that the fixing protrusions 42*a* are inserted and fixed in the fixing holes 21*a*. As a result, the flexible pipe 200 is locked from further movement.

[Industrial Applicability]

The present invention is applicable in the field of cleaning devices including domestic, commercial, and industrial cleaners.

The invention claimed is:

1. An extension pipe assembly for a vacuum cleaner, the extension pipe assembly comprising:

a suction pipe including an external pipe and an external power supply pipe which is coupled to the bottom surface of the external pipe, and to the interior of which a movable member is coupled;

a flexible pipe including an internal pipe and a power supply pipe attached to the bottom surface of the internal pipe, wherein the flexible pipe is coupled to the suction pipe such that the length of the flexible pipe is adjustable; and length adjustment means joined to the coupling portion between the suction pipe and the flexible pipe so as to lock or unlock the length adjustment function of the flexible pipe and of the suction pipe, wherein the power supply pipe is formed into a single pipe, on both internal walls of which respective conductor plates are formed to as to contact the movable member so that when the power supply pipe is inserted into the external power supply pipe, the movable member is inserted into the power supply pipe such that the movable member is movable and contacts the conductor plates to maintain a power supply state, wherein the external power supply pipe is made from plastic and integrally and fixedly coupled to a bottom surface of the external pipe by ultrasonic welding, wherein the movable member comprises:

a recess hole comprising, on at least one of upper and lower surfaces, a plurality of stamping protrusions to fix a power line with an end facing a middle portion being formed in a planar shape;

the power line firmly seated in the recess hole;

a conductive movable piece having a surface of a middle portion protruded to outside and coupled to an end of the power line.

2. An extension pipe assembly for a vacuum cleaner, the extension pipe assembly comprising:

a suction pipe including an external pipe and an external power supply pipe which is coupled to the bottom surface of the external pipe, and to the interior of which a movable member is coupled;

a flexible pipe including an internal pipe and a power supply pipe attached to the bottom surface of the internal pipe, wherein the flexible pipe is coupled to the suction pipe such that the length of the flexible pipe is adjustable; and length adjustment means joined to the coupling portion between the suction pipe and the flexible pipe so as to lock or unlock the length adjustment function of the flexible pipe and of the suction pipe, wherein the power supply pipe is formed into a single pipe, on both internal walls of which respective conductor plates are formed to as to contact the movable member so that when the power supply pipe is inserted into the external power supply pipe, the movable member is inserted into the power supply pipe such that the movable member is movable and contacts the conductor plates to maintain a power supply state, wherein the external power supply pipe is made from plastic and integrally and fixedly coupled to a bottom surface of the external pipe by ultrasonic welding, wherein the power supply pipe comprises:

a tubular casing having an upper open portion;

conductive pipes fixedly attached and extended along an entirety of a length direction of the casing on both inner walls of the casing;

a cover which sealingly closes an upper portion of the casing.

3. An extension pipe assembly for a vacuum cleaner, the extension pipe assembly comprising:

a suction pipe including an external pipe and an external power supply pipe which is coupled to the bottom surface of the external pipe, and to the interior of which a movable member is coupled, the external power supply pipe being comprised of an external power supply pipe cover and an external power supply pipe casing, and having a moveable member disposed between the external power supply cover and the external power supply casing; wherein the external power supply pipe is made from plastic and integrally and fixedly coupled to a bottom surface of the external pipe by ultrasonic welding a flexible pipe coupled to the suction pipe such that the length of the flexible pipe is adjustable, the flexible pipe including an internal pipe and an internal power supply pipe attached to the bottom surface of the internal pipe, the internal power supply pipe being comprised of an internal power supply pipe cover and an internal power supply pipe casing, and having a pair of conductor plates disposed between the internal power supply pipe cover and the internal power supply pipe casing;

wherein the conductor plates are formed on both internal walls of the internal power supply pipe as to contact the movable member so that when the power supply pipe is inserted into the external power supply pipe, the movable member is inserted into the power supply pipe such that the movable member is movable and contacts the conductor plates to maintain a power supply state, and length adjustment means joined to the coupling portion between the suction pipe and the flexible pipe so as to lock or unlock the length adjustment function of the flexible pipe and of the suction pipe.

4. The extension pipe assembly of claim 3, wherein the length adjustment means comprises:

a sleeve comprising restricting protrusions formed on an external circumference of the sleeve and a piercing slot formed between the restricting protrusions;

a locking plate inserted into the piercing slot of the sleeve, the locking plate comprising fixing protrusions at both sides of a lower surface thereof and elastic pieces formed at both ends thereof elastically biasing the locking plate;

a pressing plate inserted between the restricting protrusions; and a sliding cover being divided in two halves which are elastically coupled to each other and surround the sleeve.

* * * * *